United States Patent [19]

Diefendorf et al.

[11] 4,208,267

[45] Jun. 17, 1980

[54] FORMING OPTICALLY ANISOTROPIC PITCHES

[75] Inventors: Russell J. Diefendorf, Clifton Park, N.Y.; Dennis M. Riggs, Milford, Mass.

[73] Assignee: Exxon Research & Engineering Co., Florham Park, N.J.

[21] Appl. No.: 903,172

[22] Filed: May 5, 1978

Related U.S. Application Data

[63] Continuation-in-part of Ser. No. 813,931, Jul. 8, 1977, abandoned.

[51] Int. Cl.[2] ..... C10C 3/08

[52] U.S. Cl. ..... 208/22; 208/45; 423/447.1

[58] Field of Search ..... 208/22, 44, 45; 106/273 R; 423/447.4, 447.1

[56] References Cited

U.S. PATENT DOCUMENTS 3,919,387 11/1975 Singer ..... 423/447.4

*Primary Examiner*—Herbert Levine

*Attorney, Agent, or Firm*—Joseph J. Dvorak

[57] ABSTRACT

An improved process for preparing liquid-crystal containing pitches comprises extracting carbonaceous isotropic pitches with an organic solvent system to provide a solvent insoluble fraction which when heated for 10 minutes or less and to temperatures in the range of about 230° C. to 400° C. will upon polarized light microscopy examination of cooled samples display greater than 75% of an optically anisotropic phase.

21 Claims, 5 Drawing Figures

FORMING OPTICALLY ANISOTROPIC PITCHES

CROSS-REFERENCE TO RELATED APPLICATIONS

This application is a Continuation-in-Part of U.S. patent application Ser. No. 813,931, filed July 8, 1977 and now abandoned.

BACKGROUND OF THE INVENTION

1. Field of the Invention

This invention relates generally to the formation of deformable, optically anisotropic pitches particularly useful in the formation of shaped carbon articles, such as electrodes and the like. More particularly, this invention relates to the formation of deformable, optically anisotropic pitches particularly useful in the formation of carbon and graphite filaments of continuous lengths.

2. Description of the Prior Art

Petroleum, coal tar and chemical pitches because of their high carbon to hydrogen ratio, have the potential, at least, to be used commercially in forming a wide variety of carbon artifacts. One carbon artifact of particular commercial interest today is carbon fiber. Hence, although particular reference is made herein to carbon fiber technology, it will be appreciated that this invention has applicability in areas other than carbon fiber formation.

Referring now in particular to carbon fibers, suffice it to say that the use of carbon fibers in reinforcing plastic and metal matrices has gained considerable commercial acceptance where the exceptional properties of the reinforced composite materials, such as their high strength to weight ratios, clearly offset the generally high costs associated with preparing them. It is generally accepted that large scale use of carbon fibers as a reinforcing material would gain even greater acceptance in the marketplace if the costs associated with the formation of the fibers could be substantially reduced. Much of the commercially available carbon fiber today is obtained by carbonizing synthetic polymers, such as polyacrylonitrile. The high cost of such carbon fibers is due in part to the high cost of the polyacrylonitrile fiber being carbonized, the low yield of carbon fiber resulting therefrom and the processing steps necessary to maintain a desirable physical structure of the atoms in the fiber which will impart adequate strength to the resultant carbon fiber.

More recently, the formation of carbon fibers from relatively inexpensive pitches has received considerable attention. Use of relatively inexpensive pitch materials, however, has not substantially reduced the cost of the formation of carbon fibers having commercially acceptable physical properties.

To date, all high strength, high modulus carbon fibers prepared from pitches are characterized, in part, by the presence of carbon crystallites preferentially aligned parallel to the fiber axis. This highly oriented type of structure in the carbon fiber has been obtained either by introducing orientation into the precursor pitch fiber by high temperature stretching of the pitch fiber or by first forming a pitch for fiber formation which possesses considerable structure.

High temperature stretching of pitch fibers has not resulted in inexpensive fibers of adequate strength and modulus for numerous reasons including the difficulty in stretching the pitch fiber at high temperatures without breaking the fibers, and the concomitant cost of equipment for carrying out the stretching operation, to mention a few.

In forming a carbon fiber from a pitch material which has a high degree of orientation, it has been considered necessary to thermally transform the carbonaceous pitch, at least in part, to a liquid crystal or the so-called "mesophase" state. This mesophase state has been characterized as consisting of two components, one of which is an optically anisotropic, highly oriented material having a pseudocrystalline nature and the other, an isotropic nonoriented material. As is disclosed, for example, in U.S. Pat. No. 4,005,187, the nonmesophase portion of the pitch is readily soluble in pyridine and quinoline and the mesophase portion is insoluble in these solvents. Indeed, the amount of insoluble material in the thermally treated pitch is treated as being equivalent to the amount of mesophase formed. In any event, this thermal processing step is expensive, particularly in terms of mesophase production rate. For example, at 350° C., the minimum temperature generally required to convert an isotropic pitch to the mesophase state, at least one week of heating is usually necessary and then mesophase content of the pitch is only about 40%. In addition thereto, the formation of fibers from pitches containing as much as 60% of mesophase material, for example, still requires extensive and costly postspinning treatments in order to provide a fiber which has the requisite Young's modulus rendering these fibers commercially attractive and important.

SUMMARY OF THE INVENTION

Generally speaking, it has now been discovered that isotropic carbonaceous pitches contain a separable fraction which, when heated to temperatures in the range of from about 230° C. to about 400° C. for 10 minutes or less, develop an optically anisotropic phase of greater than 75%.

The highly oriented, optically anisotropic pitch material obtained in accordance with this invention has a substantial solubility in pyridine and in quinoline. Consequently, such material will hereinafter be referred to as a "neomesophase" pitch, the prefix "neo", which is Greek for "new", being used to distinguish this new material from mesophase pitches which are substantially insoluble in pyridine and in quinoline.

Thus, one embodiment of the present invention contemplates treating typical graphitizable isotropic pitches to separate a solvent insoluble fraction hereinafter referred to as a "neomesophase former fraction" of the pitch, which fraction is readily converted into a deformable neomesophase containing pitch of unusual chemical and thermal stability. Since a neomesophase former fraction of an isotropic pitch is insoluble in solvents such as benzene and toluene, solvent extraction is conveniently employed to effect a separation of a neomesophase former fraction.

In another embodiment of the present invention, there is provided a deformable pitch containing greater than 75% and preferably greater than 90% of an optically anisotropic phase and below about 25 wt. % quinoline insolubles.

These and other embodiments of the invention will be more clearly apparent from the following detailed description when read in conjunction with the accompanying drawings.

DETAILED DESCRIPTION OF THE INVENTION

Figure 1:
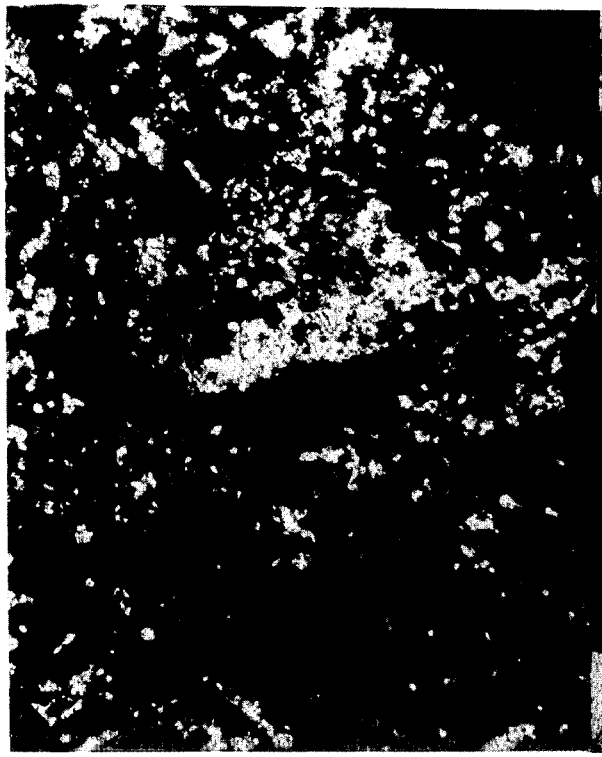
FIG. 1 is a photomicrograph under polarized light at a magnification factor of 500X of a neomesophase former fraction which has been converted to greater than 95% neomesophase according to the invention.

The term "pitches" used herein includes petroleum pitches, coal tar pitches, natural asphalts, pitches contained as by-products in the naphtha cracking industry, pitches of high carbon content obtained from petroleum asphalt and other substances having properties of pitches produced as by-products in various industrial production processes. As will be readily appreciated, "petroleum pitch" refers to the residuum carbonaceous material obtained from distillation of crude oils and from the catalytic cracking of petroleum distillates. "Coal tar pitch" refers to the material obtained by distillation of coal. "Synthetic pitches" refers generally to residues obtained from the distillation of fusible organic substances.

Generally, pitches having a high degree of aromaticity are suitable for carrying out the present invention. Indeed, aromatic carbonaceous pitches having carbon contents from about 88% by weight to about 96% by weight and a hydrogen content of about 12% by weight to about 4% by weight are generally useful in the process of this invention. While elements other than carbon and hydrogen, such as sulfur and nitrogen to mention a few, are normally present in such pitches, it is important that these other elements do not exceed 4% by weight of the pitch and this is particularly true in forming carbon fibers from these pitches. Also, these useful pitches typically will have a number average molecular weight of the order of from about 300 to about 4000.

Another important characteristic of the starting pitches employed in this invention is that these pitches have generally less than 5 wt. % and preferably less than 0.3 wt. %, and most preferably less than 0.1 wt. %, of foreign substances which are referred to as quinoline insolubles (hereinafter QI). The QI of the pitch is determined by the standard technique of extracting the pitch with quinoline at 75° C. In the starting pitches, the QI fraction typically consists of coke, carbon black, ash or mineral water found in the pitches. The presence of these foreign substances is deleterious to subsequent processing, especially fiber formation.

Those petroleum pitches and coal tar pitches which are well known graphitizable pitches have the foregoing requirements and are preferable starting materials for practicing the present invention.

Thus, it should be apparent that commercially available isotropic pitches, particularly commercially available natural isotropic pitches which are known to form a mesophase pitch in substantial amounts, for example of the order of 75% to 90% by weight, during heat treatment to temperatures where the pitch is fluid but below temperatures where coking occurs, are especially preferred inexpensive starting materials for practicing the present invention. On the other hand, those pitches, exemplified by certain coal tar pitches, which remain isotropic at temperatures where the pitch is fluid and become anisotropic when heated to elevated temperatures where coking also occurs, are not suitable in practicing the present invention.

As stated above, it has been discovered that the preferred isotropic pitches mentioned hereinabove contain a separable fraction, herein referred to as a "neomesophase former or NMF fraction", which is capable of being converted to an optically anisotropic pitch containing greater than 75% and even greater than 90% of a highly oriented pseudocrystalline material (hereinafter neomesophase) generally in less than 10 minutes and especially in less than a minute, when the NMF fraction is heated to temperatures in the range of from about 230° C. to about 400° C.

It should be noted that the extent of neomesophase formation resulting from heating an NMF fraction of pitch is determined optically, i.e., by polarized light microscopy examination of a polished sample of the heated pitch which has been allowed to cool to ambient room temperature, e.g., 20° C. to 25° C. The neomesophase content is determined optically since the neomesophase material prepared by heating the concentrated and isolated NMF fraction has a significant solubility in boiling quinoline and in pyridine. Indeed, the NMF fraction of the pitch when heated to temperatures between about 230° C. to about 400° C. provides an optically anisotropic deformable pitch containing generally below about 25 wt. % quinoline insolubles and especially below about 15 wt. % QI. As indicated, the amount of QI is determined by quinolie extraction at 75° C. The pyridine insolubles (hereinafter PI) are determined by Soxhlet extraction in boiling pyridine.

Additionally, it should be noted that by heating an NMF fraction to a temperature about 30° C. above the point where the NMF fraction becomes a liquid, substantially the entire material is converted to a liquid crystal having large coalesced domains in time periods generally less than 10 minutes; however, it is not necessary for carbon fiber production to have large coalesced domains. Indeed, at temperatures below the point where the NMF fraction becomes liquid, the NMF fraction will have been converted to greater than 75% neomesophase having a fine domain structure. The point to be noted is that the exact nature of the NMF fraction will vary depending upon numerous factors such as the source of the NMF fraction, the method of separation from nonmesophase forming materials and the like. In general, however, NMF fraction is characterized by the rapidity in which it is thermally converted to an optically anisotropic pitch. As indicated, an NMF pitch fraction generally is characterized also by its insolubility in benzene, for example, at ambient temperatures, i.e., at temperatures of about 22° C. to 30° C. Indeed, since neomesophase former fraction of an isotropic pitch is insoluble in benzene and other solvents and mixtures of solvents having a solubility parameter substantially the same as benzene, solvent extraction is conveniently employed to separate the NMF fraction from a substantial portion of the isotropic pitch. Generally, the solvent system will have a solubility parameter of between about 8.0 to 9.5 and preferably of 8.7 to 9.2 at 25° C.

The solubility parameter, δ, of a solvent or mixture of solvents is given by the expression $$\delta = \left( \frac{\Delta H_v RT}{V} \right)^{\frac{1}{2}}$$

where $H_v$ is the heat of vaporization of the material

R is the molar gas constant

T is the temperature in °K. and

V is the molar volume.

In this regard, see, for example, J. Hildebrand and R. Scott, "Solubility of Non-Electrolytes", 3rd edition, Reinhold Publishing Co., New York (1949) and "Regular Solutions", Prentice Hall, New Jersey (1962). The solubility parameters at 25° C. for some typical organic solvents are as follows: benzene, 9.2; toluene, 8.8; xylene, 8.7; and cyclohexane, 8.2. Among the foregoing solvents, toluene is preferred. Also, as is well known, solvent mixtures can be prepared also to provide a solvent system with a desired solubility parameter. Among mixed solvent systems, a mixture of toluene and heptane is preferred having greater than about 60 volume % toluene such as 60% toluene-40% heptane, and 85% toluene-15% heptane. As will be appreciated, other variations in temperature and solubility parameter can be employed to obtain a fraction of the pitch equivalent to that obtained from a solvent system with the above-described solubility parameter.

Thus, in the practice of the present invention, a typical graphitizable isotropic pitch having below about 5 wt. % QI (i.e., coke, carbon, minerals and the like) and preferably below about 0.3 wt. % QI is contact with sufficient solvent to dissolve at least a portion of the isotropic pitch and to leave a solvent insoluble fraction of the pitch, at least a part of which is benzene insoluble, at ambient temperatures, and preferably at 28° C. Most conveniently, such an isotropic pitch can be treated with benzene or toluene at ambient temperatures, i.e., of about 25° C. to about 30° C., in amounts sufficient to dissolve at least a portion of the pitch, thereby leaving an insoluble concentrated neomesophase former fraction. Typically, from about 5 ml to about 150 ml, and preferably about 10 to 20 ml, of benzene per gram of isotropic graphitizable pitch should be employed to provide an NMF fraction with preferred properties.

Among the preferred properties of the NMF fraction are a C/H ratio greater than 1.4, and preferably between about 1.60 to 2.0. Typically, the preferred fraction separated from the isotropic pitch will have a sintering point, i.e., a point at which phase change can first be noted by differential thermal analysis of a sample in the absence of oxygen, below 350° C. and generally in the range of from about 310° C. to about 340° C. Most desirably, the NMF fraction separated from an isotropic pitch will have a solubility parameter greater than about 10.5 at 25° C.

As will be appreciated, the choice of solvent or solvents employed, the temperature of extraction and the like will affect the amount and the exact nature of the neomesophase former fraction separated. Hence, the precise physical properties of the NMF fraction may vary; however, in carbon fiber formation, it is especially preferred that the fraction of the isotropic pitch that is not soluble be that fraction will, upon heating to a temperature in the range of from about 230° C. to about 400° C., be converted to an optically anisotropic pitch containing greater than 75% and especially greater than 90% neomesophase. In other words, a sufficient portion of an isotropic pitch is dissolved in an organic solvent or mixture of solvents to leave a solvent insoluble fraction which, when heated in the range of from about 230° C. to about 400° C. for 10 minutes or less and then allowed to cool to ambient room temperature will, by polarized light microscopy at magnification factors of from 10 to 1000, for example, be found to be greater than 75% optically anisotropic. It should be noted that the neomesophase material obtained from a toluene insoluble NMF fraction will display large coalesced domains under polarized light whereas neomesophase formed from the binary solvent (e.g., toluene-heptane mixture) insoluble fraction will display a finer structure under polarized light.

Other distinctions are worth noting. For example, when solely benzene or solely toluene are used as the solvent for extracting the pitch, the neomesophase former fraction will generally be converted to greater than 90% of an optically anisotropic phase and even greater than 95% neomesophase when samples of the neomesophase former fraction that have been heated from about 230° C. to about 400° C. for 10 minutes and even less are allowed to cool to ambient room temperature and examined under polarized light. In contrast, when a toluene/heptane binary solvent system is employed for the extraction the neomesophase former fraction apparently also includes some isotropic material such that upon heating for 10 minutes or less only about 75% neomesophase will develop on cooling to room temperature. The lower neomesophase content obtained in the latter instance, however, does not diminish the utility of such fraction in carbon fiber formation, for example. Indeed, neomesophase obtained from binary solvent insoluble fractions of pitch are quite useful in fiber formation since these fractions tend to have lower softening points, thereby enhancing extrudability into fibers. Moreover, considerable orientation is introduced during spinning.

Returning to the process of this invention, prior to contacting the isotropic pitch with the appropriate solvent to isolate and separate the neomesophase former fraction of the pitch, it is particularly preferred to mechanically or otherwise comminute the pitch into smaller particles on the order of less than 100 mesh size. The mesh size referred to herein is the Taylor screen mesh size. Producing a pitch with the requisite particle size can be achieved by very simple techniques such as grinding, hammer milling, ball milling and the like.

After obtaining a pitch of suitable particle size, the pitch is extracted with an organic solvent or mixture of solvents as previously described, thereby leaving a solvent insoluble neomesophase former fraction. By way of example with commercially available Ashland 260 pitch generally 75% to 90% of the pitch will be dissolved. With commercially available Ashland 240 pitch, about 80% to 90% of the pitch should be dissolved.

As indicated previously, the solvent pretreatment may be employed over a wide range of temperatures such as temperatures in the range of about 25° C. to 200° C. although ambient temperature, i.e., a temperature of about 28° C., is particularly preferred in order to avoid the cost of cooling or heating the solvent during solvent extraction.

The neomesophase former fraction obtained by the foregoing techniques when heated at a temperature of above about 230° C. to about 400° C. is substantially converted to an anisotropic pitch containing greater than 75% neomesophase in a time period generally less than 10 minutes. Indeed, as soon as the NMF fraction is at about the point where it becomes fluid, this conversion is so rapid that it can be thought of as occurring almost instantaneously; however, this conversion to neomesophase is more noticeable as large coalesced domains at temperatures of about 30° C. above the melting point.

The formation of substantially complete neomesophase containing pitch from an NMF fraction in accordance with the present invention can be demonstrated by visual observation of heated samples that have been allowed to cool to ambient room temperature using polarized light, microscopic techniques. If the heated samples are quenched, especially if the binary solvent insoluble samples are quenched, the amount of neomesophase observed may vary be considerably less than if the samples are allowed to cool to room temperature more slowly, e.g., over a half-hour period.

As will be appreciated, in the past forming carbon articles, such as fibers, from isotropic pitches required heating the isotropic pitches at elevated temperatures for a long period of time in order to convert the isotropic pitch to one having a mesophase content in the range of about 40% to 70%. Indeed, the preferred technique in U.S. Pat. No. 3,974,264 for preparing a mesophase pitch is recited as heating the isotropic pitch at between 380° C. to 440° C. for from 2 to 60 hours. As indicated in the just-referenced patent, mesophase pitches so prepared will exhibit viscosities of the order 10 poise to about 200 poise at temperatures of about 300° C. to about 380° C. At these viscosities, fibers can be spun from the mesophase-containing pitch; however, when heating the isotropic pitches of the referenced patent, especially at temperatures of about 400° C. and higher, considerable weight loss occurs evidencing chemical and thermal instability of these materials. Indeed, 90% and greater mesophase containing pitches prepared by merely thermally treating an isotropic pitch generally are not chemically or thermally stable at spinning temperatures. In contrast thereto, the practice of the present invention provides a highly oriented, indeed from 75% to substantially 100% neomesophase material which can be heated to temperatures up to 400° C. without any substantial weight loss and without substantial chemical reaction. At temperatures of up to 400° C., the neomesophase material of this invention does not undergo significant coking and exhibits typically less than about 5% weight loss. Consequently, the neomesophase pitch of the present invention can be elevated to temperatures at which it will exhibit a suitable viscosity for spinning and still be at a temperature below the temperature at which coking normally is likely to occur. Hence, carbon articles such as fibers can be readily prepared in accordance with the present invention at temperatures in the range of about 230° C. to 400° C., whereby at least 75% neomesophase pitch is formed in times less than about 3 minutes and thereafter forming said high neomesophase containing pitch into a shaped article, such as fibers, and subjecting this shaped article to an oxidizing atmosphere at temperatures in the range of about 200° C. to 350° C. to render the article infusible. Thereafter the fibers are carbonized by heating in an inert atmosphere at elevated temperatures in the range, for example, of about 800° C. to about 2800° C. and preferably between about 1000° C. and 2000° C. for a time sufficient to carbonize the fibers.

A more complete understanding of the process of this invention can be obtained by reference to the following examples which are illustrative only and not meant to limit the scope thereof which is fully expressed in the hereinafter appended claims.

EXAMPLE 1

A commercially available petroleum pitch, Ashland 240, was ground, sieved (100 Taylor mesh size) and extracted with benzene at 28° C. in the ratio of 1 gram of pitch per 100 ml of benzene. The benzene insoluble fraction was separated by filtration and dried. Thereafter a sample of the insoluble fraction, the neomesophase former fraction, was subjected to differential thermal analysis (DTA) and thermal gravimetric analysis (TGA) by heating the sample in the absence of oxygen at a rate of 10° C. per minute to a temperature of 350° C. The DTA showed a sintering point of below 350° C. and TGA showed a weight loss during heat treatment of about 3%. As can be seen (FIG. 1) from the photomicrograph under polarized light (magnification factor of 500X), a polished sample of the heated benzene insoluble pitch shows a microstructure indicative of greater than about 95% optically anisotropic neomesophase material.

Figure 2:
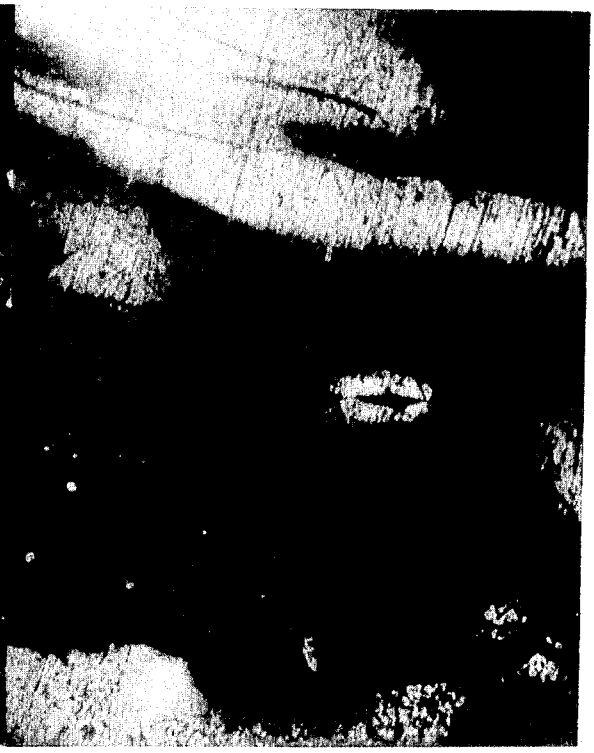
FIG. 2 is a photomicrograph under polarized light at a magnification factor of 500X of a commercially available pitch which was heated to 350° C. at a rate of 10° C. per minute.

For comparison, when a sample of the same untreated Ashland 240 pitch was heated up to 350° C. at 10° C. per minute, the TGA indicated a weight loss of about 28%. Moreover, as can be seen in FIG. 2 from the photomicrograph under polarized light (magnification factor of 500X) of a polished sample of the heated pitch, no mesophase material can be observed.

EXAMPLE 2

Figure 3:
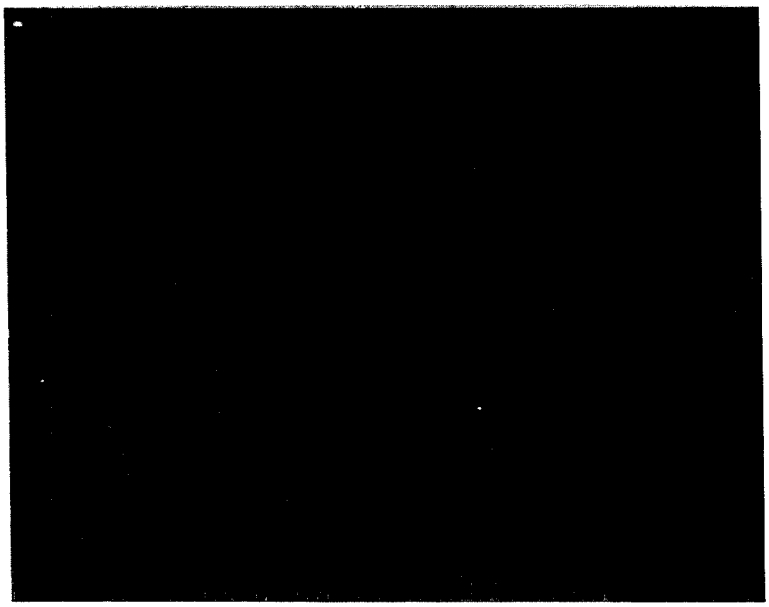
FIG. 3 is a photomicrograph under polarized light at a magnification factor of 500X of a commercially available heat treated pitch.

In this example, the same untreated commercially available pitch was heated to 400° C. and held there for 1.5 hours. Thereafter the heated pitch was cooled, ground, sieved (100 Taylor mesh size) and subjected to TGA by heating up to 380° C. at a rate of 10° C. per minute. This treatment still resulted in very limited mesophase formation as can be seen from the photomicrograph of FIG. 3 (500X magnification factor). Weight loss during thermal analysis was about 36%.

Figure 4:
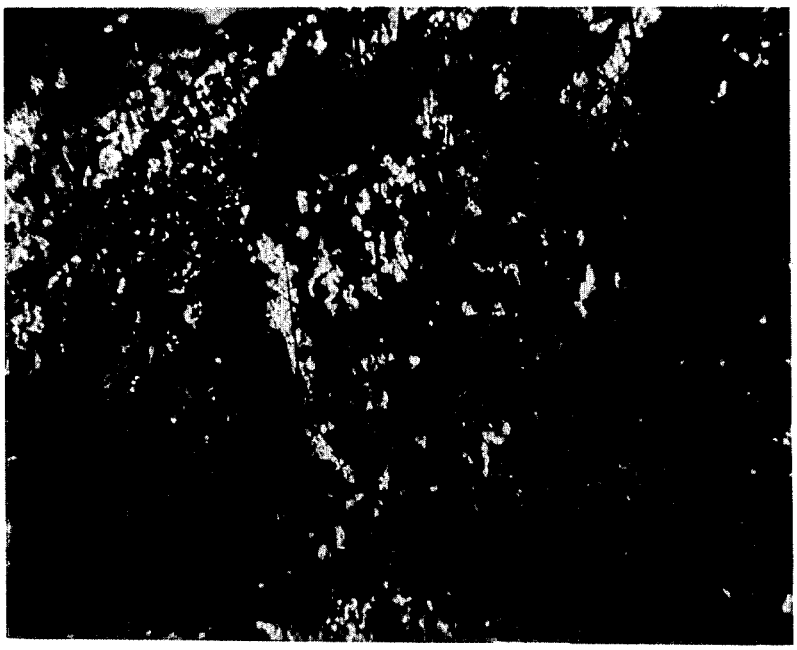
FIG. 4 is a photomicrograph under polarized light at a magnification factor of 500X of a neomesophase former fraction according to this invention which has been converted to 95% neomesophase.

In contrast, a sample of the heated pitch was treated with benzene at 24° C. (1 gm pitch/100 ml benzene) and filtered. The insoluble portion then was washed with fresh benzene until the filtrate was clear. The insoluble neomesophase former fraction, after drying, was subjected to TGA as above. During thermal analysis, weight loss was about 3%. The photomicrograph of FIG. 4 (magnification factor of 500X) indicates about 95% neomesophase material.

EXAMPLE 3

Figure 5:
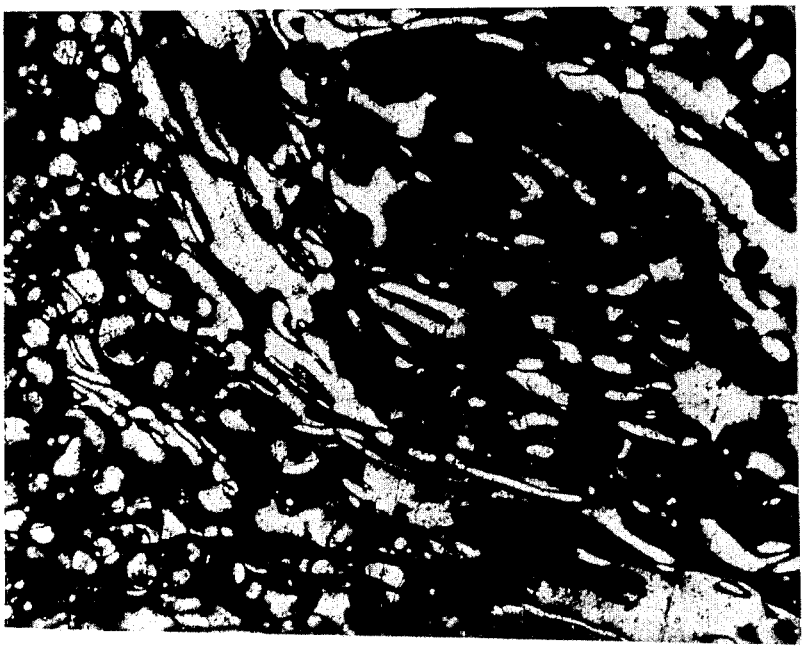
FIG. 5 is a photomicrograph under polarized light at a magnification factor of 250X of yet another neomesophase former fraction prepared according to this invention which was converted to 80% neomesophase by heating at 450° C. for 0.5 hours.

Following the general techniques outlined above, a commercially available pitch was extracted with toluene (3.8 l per 453 gm) to provide a toluene insoluble neomesophase former fraction. This material was then heated to 450° C. and held at that temperature for approximately 0.5 hours. The photomicrograph (magnification factor of 250X) under polarized light of the so-heated sample (FIG. 5) shows about 80% neomesophase material; nonetheless, the so-treated material when extracted with boiling quinoline had a quinoline insoluble content only of about 12%.

EXAMPLE 4

Following the general procedures outlined above, a neomesophase former fraction was prepared from Ashland 260 pitch. Approximately 0.5 kg of pitch was stirred at room temperature in 4 l of benzene. After filtration the insoluble fraction was washed with 1500 ml of benzene and then 2000 ml of benzene. Next the benzene insoluble neomesophase former fraction was dried. Thereafter about 2 grams of the dried neomesophase former fraction was charged into a spinning die under a nitrogen atmosphere. The die had a diameter of 1/64" and a length to diameter ratio of 1 to 8. The spinning die also was provided with a rotor extending coaxially into the cylindrical die cavity. The rotor had a conical tip of substantially the same contour of the die cavity and a concentric channel width substanstantially equal to the diameter of the die orifice. The charge was heated at a rate of 10° C. per minute to 380° C. Then the rotor was driven at speeds ranging from 50 to 2000 rpm. Good continuous fibers were then spun under a nitrogen pressure of about 5 psi. The fibers so spun were subjected to an oxidation step by heating from room temperature to 280° C. in air at a rate of 15° C. per minute and then holding the fiber at 280° C. for 20 minutes. After heating the fibers in an inert nitrogen atmosphere to 1000° C., the fibers were found to have a Young's modulus of about $21\times10^6$ psi.

EXAMPLE 5

This example illustrates the use of a binary solvent system for obtaining a neomesophase former fraction. In this example, a commercially available pitch (Ashland 240) was heated in vacuo in an autoclave for 50 minutes in the temperature range of 104° to 316° C., then for 110 minutes from 316° to 420° C. and finally for 60 minutes at 420° C. At 385° C., atmospheric pressure was attained and the autoclave was opened and 97.9% of the charge was recovered. Following the general procedure outlined in the above examples, various samples of approximately 40 g each of the pulverized solid pitch was extracted with about 320 ml of solvent, filtered, reslurried in 120 ml of solvent. Thereafter, the solid was filtered, worked with solvent and dried in vacuo at 120° C. to a constant weight. These samples were heated to 400° C. and the neomesophase content determined by polarized light technique after the sample cooled to ambient room temperature. Additionally, samples which were heated in a spinning die and spum into fibers were examined under polarized light.

The solvents and the results obtained are given in Table I below:

TABLE 1

| Run | Solvent | Vol. % | Wt. % Solvent Insoluble Fraction | Softening Range, °C. Insoluble Fraction | % Neo-Mesophase | % Neomesophase, Spun Fiber |
|---|---|---|---|---|---|---|
| A | toluene | 100% | 30.0 | 325–350 | >90 | 100% |
| B | toluene/heptane | 85/15 | 34.3 | 325–350 | >90 | 100% |
| C | toluene/heptane | 70/30 | 39.9 | 300–325 | >50 | 100% |
| D | toluene/heptane | 60/40 | 42.3 | 275–300 | 0 | >60% |

Apparently the material from Run D was too viscous as it cooled from 400° C. and hence neomesophase failed to develop; nonetheless, the short heating time in the spinning die and subsequent orientation during spinning resulted in formation of significant amounts of neomesophase material.

EXAMPLE 6

This example illustrates the use of a chemical pitch from a chemical vacuum unit. The pitch had a softening point of 130° C. It was extracted in the manner outlined above with a binary solvent (70 vol. % toluene-30% heptane) to provide 24.8 wt. % of an NMF fraction having a softening point of about 375° C. to 400° C. and which upon heating at 400° C. for 10 minutes was converted to greater than 90% neomesophase material.

What is claimed is:

1. A process for producing an optically anisotropic, deformable pitch comprising:

treating a carbonaceous isotropic pitch with an organic solvent system, said organic solvent system having a solubility parameter at 25° C. of between about 8.0 and about 9.5, said treating being at a temperature and with an amount of organic solvent system sufficient to provide a solvent insoluble fraction having a sintering point below about 350° C. when determined by differential thermal analysis of a sample of the insoluble fraction in the absence of oxygen;

separating said solvent insoluble fraction from said organic solvent system; and heating said solvent insoluble fraction to a temperature in the range of from about 230° C. to about 400° C. whereby said fraction is converted to a deformable pitch containing greater than 75% of an optically anisotropic phase and which phase when extracted with quinoline at 75° C. contains less than about 25 wt. % of substances insoluble in said quinoline.

2. The process of claim 1 wherein said organic solvent system is used in an amount sufficient to provide a solvent insoluble fraction having a sintering point in the range of fraom about 310° C. to about 340° C.

3. The process of claim 1 wherein the solubility parameter of said organic solvent system is between 8.7 and 9.2.

4. The process of claim 3 wherein the organic solvent system consists essentially of benzene.

5. The process of claim 3 wherein the organic solvent consists essentially of toluene.

6. The process of claim 3 wherein said organic solvent system is a mixture of organic solvents.

7. The process of claim 6 wherein said mixture of solvents consists essentially of toluene and heptane.

8. The process of claim 7 wherein said toluene is present in amounts greater than about 60 volume %.

9. The process of claim 1 wherein said isotropic pitch is treated with from about 5 milliliters to about 150 ml of said organic solvent system per gram of pitch at ambient temperature.

10. The process of claim 9 wherein said temperature is in the range of about 22° C. to about 30° C.

11. A process for producing a carbonaceous pitch containing greater than about 90 wt. % of an optically anisotropic phase which is at least 75 wt. % soluble in quinoline when extracted with quinoline at 75° C. comprising: treating a carbonaceous isotropic pitch with an organic solvent system having a solubility parameter of between about 8.0 and 9.5, said treating being at a temperature and with an amount of said organic solvent system sufficient to provide a solvent insoluble fraction which is benzene insoluble at a temperature in the range of from about 22° C. to about 30° C. and which undergoes a phase change below about 350° C. when a sample thereof is subjected to differential thermal analysis in the absence of oxygen; and, thereafter, heating said solvent insoluble fraction to a temperature in the range of from about 230° C. to about 400° C., whereby said solvent insoluble fraction is converted to a pitch containing greater than 90% of an optically anisotropic phase and which is at least 75 wt. % soluble in quinoline when extracted with quinoline at 75° C.

12. The process of claim 11 wherein said insoluble fraction is heated to a temperature about 30° C. above the point where it becomes fluid whereby said fraction is converted to an optically anisotropic pitch having greater than 90% optically anisotropic phase in less than 10 minutes.

13. In the process for preparing an optically anisotropic deformable carbonaceous pitch containing greater than 75% of an optically anisotropic phase by heating an isotropic carbonaceous pitch to temperatures in the range of from about 230° C. to about 400° C., the improvement comprising:

extracting said isotropic carbonaceous pitch with a solvent selected from organic solvents and mixtures thereof, said solvent being at a temperature and in an amount sufficient to provide a solvent insoluble fraction having a carbon/hydrogen ratio of between about 1.6 to 2.0 and capable of undergoing a phase change below about 350° C. as determined by differential thermal analysis of a sample of said insoluble fraction in the absence of oxygen; and thereafter heating said solvent insoluble fraction at temperatures in the range of about 230° C. to about 400° C. whereby said solvent insoluble fraction is converted to a deformable pitch containing greater than 75% of an optically anisotropic phase which is greater than 75% by weight soluble in quinoline when extracted by quinoline at 75° C.

14. A process for preparing carbonaceous pitch containing greater than 75% of an optically anisotropic oriented phase and less than about 25 wt. % quinoline insolubles comprising: extracting a carbonaceous isotropic pitch containing less than about 5 wt. % quinoline insolubles with an organic solvent system selected from organic solvents and mixtures thereof, said organic solvent system having a solubility parameter of between about 8.0 to about 9.5, the ratio of said organic solvent system to said isotropic carbonaceous pitch being in the range of from about 5 ml to 150 ml of solvent per gram of isotropic pitch, said extraction being conducted at temperatues in the range of from about 22° C. to about 30° C. whereby a solvent insoluble fraction is obtained; separating said solvent insoluble fraction from said solvent system; drying said separated insoluble fraction in an oxygen-free atmosphere; and, thereafter heating said dried solvent insoluble fraction at a temperature in the range of from about 230° C. to about 400° C. whereby said solvent insoluble fraction is converted to pitch containing greater than 75% of an optically anisotropic oriented phase and less than about 25 wt. % quinoline insolubles.

15. A process for preparing a pitch fiber comprising:

extracting a graphitizable isotropic pitch with an organic solvent system having a solubility parameter of between about 8.0 to about 9.5 at 25° C., said pitch containing less than 5 wt. % of quinoline insolubles as determined by extraction with quinoline at 75° C., said extraction being conducted at a temperature and with an amount of said solvent system sufficient to provide a solvent insoluble fraction which if heated for 10 minutes and less to a temperature about 30° C. above the point where said insoluble fraction becomes fluid, said fraction is converted to a pitch, which being allowed to cool by ambient temperature will have greater than 75% by weight of an optically anisotropic phase and less than 25 wt. % of substances insoluble in quinoline when said pitch is extracted with quinoline at 75° C.;

heating said solvent insoluble fraction to a temperature of about 300° C. to about 380° C. while extruding said heated insoluble fraction through an extrusion orifice thereby forming a pitch fiber.

16. The process of claim 15 wherein said solvent system is a mixture of toluene and heptane containing greater than about 60 volume % toluene.

17. A carbonaceous pitch having a suitable viscosity for spinning at temperatures in the range of from about 230° C. to 400° C. and containing greater than 75% by weight of an optically anisotropic phase and which phase is less than about 25 wt. % insoluble in quinoline when extracted with quinoline at 75° C.

18. The carbonaceous pitch of claim 17 in which the optically anisotropic phase is less than about 15 wt. % insoluble in quinoline when extracted by quinoline at 75° C.

19. The pitch of claim 18 containing greater than 90% of an optically anisotropic phase.

20. A carbonaceous pitch which: (1) when heated to temperatures up to about 400° C. at a rate of about 10° C. per minute exhibits a weight loss of less than about 5%; (2) when heated at temperatures of above about 230° C. to about 400° C. is converted to a pitch which contains greater than 75% by weight of an optically anisotropic phase which is at least 75% by weight soluble in quinoline when said heated pitch is extracted with quinoline at 75° C.; and, (3) when heated to temperatures of from about 230° C. to about 400° C. exhibits a suitable viscosity for spinning.

21. A carbonaceous pitch fiber which greater than 75% by weight thereof is an optically anisotropic phase and less than 25 wt. % of which phase is insoluble when extracted with quinoline at 75° C.

* * * * *

UNITED STATES PATENT OFFICE

CERTIFICATE OF CORRECTION

PATENT NO. : 4,208,267

DATED : June 17, 1980

INVENTOR(S) : Russell J. Diefendorf et al

It is certified that error appears in the above-identified patent and that said Letters Patent are hereby corrected as shown below:

Column 5, lines 11 to 14, the equation for the solubility parameter should appear as follows:

$$\delta = \left( \frac{H_V - RT}{V} \right)^{1/2}$$

Signed and Sealed this

*Fourth* Day of *November 1980*

[SEAL]

*Attest:*

SIDNEY A. DIAMOND

*Attesting Officer*

*Commissioner of Patents and Trademarks*